US006499563B1

(12) United States Patent
Bremick

(10) Patent No.: US 6,499,563 B1
(45) Date of Patent: Dec. 31, 2002

(54) PROTECTIVE CAP FOR LADDERS

(75) Inventor: Lori J. Bremick, Louisville, KY (US)

(73) Assignee: Louisville Ladder Group, LLC, Louisville, KY (US)

( * ) Notice: Subject to any disclaimer, the term of this patent is extended or adjusted under 35 U.S.C. 154(b) by 0 days.

(21) Appl. No.: 09/881,590

(22) Filed: Jun. 14, 2001

(51) Int. Cl.[7] ..... E04G 5/02; E06C 7/06
(52) U.S. Cl. ..... 182/108; 182/214
(58) Field of Search ..... 182/107, 108, 182/214, 129

(56) References Cited

U.S. PATENT DOCUMENTS 2,904,128 A * 9/1959 Boham et al. ..... 182/108
4,771,862 A * 9/1988 Garland ..... 182/108
4,899,848 A * 2/1990 Parr ..... 182/108
5,533,591 A * 7/1996 Kiska ..... 182/108
5,758,745 A * 6/1998 Beggs et al. ..... 182/207
5,950,761 A * 9/1999 Murphy ..... 182/108

* cited by examiner

*Primary Examiner*—Daniel P. Stodola
*Assistant Examiner*—Hugh B. Thompson
(74) *Attorney, Agent, or Firm*—Harness, Dickey & Pierce, P.L.C.

(57) ABSTRACT

A protective ladder cap for fitting over the end of a rail of a ladder is provided. The cap has an open end for fitting over the rail and a closed end. The ladder cap has tapered internal ribs for engaging the end of a side rail of a ladder. The ladder caps prevent the ladder side rails from damaging the surface upon which the ladder leans when in use.

31 Claims, 3 Drawing Sheets

PROTECTIVE CAP FOR LADDERS

FIELD OF THE INVENTION

The present invention relates to ladders and, more particularly, to protective caps that secure over the ends of the rails of a ladder to protect the surface upon which the ladder leans when in use.

BACKGROUND OF THE INVENTION

Ladders have been used for decades by homeowners and commercial entities. Without a doubt, ladders provide great utility to those that use them. In decades past, most ladders were made of wood, but that has changed. Most ladders today are made of aluminum or fiberglass. Aluminum or fiberglass is desirable because the materials are lightweight and durable. Nonetheless, the rails that form the sides of the ladder have a tendency to cause damage to the surface upon which they are leaning. Further, hard plastic end pieces are often times used to protect the ends of the rails and are prone to damage the surface upon which they rest. It is not uncommon for the ladders to leave scratches and marks on, for example, vinyl siding.

Industry recognized this problem and, for a number of years, has offered protective caps that fit over the ends of the ladder rails. The caps are typically made from a pliable plastic. The caps serve to protect the surface upon which the ladder leans.

A problem, however, not addressed by the prior art is that ladder rails are not all sized the same. Thus, a protective cap designed to fit on one ladder rail will not fit on all ladder rails. If a user attempts to place a protective cap that is larger than the ladder rail cross-section, the cap will not fit securely on the ladder and can easily fall off the ladder rail. If a user attempts to place a protective cap on the ladder rail that is too small, it may not fit at all, or, if forced over the ladder rail, it may split after some time or during use. Further, the user often times does not know the size of the ladder rail. It is therefore much easier to buy a product that is adapted to fit over a broader range of varying sized side rails

SUMMARY OF THE INVENTION

This invention is directed to a protective ladder cap for fitting over the end of a rail of a ladder. The cap has an open end for fitting over the rail and a closed end. The cap has at least one elongated internal rib that tapers from a lower rib height closer to the open end than the closed end to a higher rib height closer to the closed end than the open end. In the preferred embodiment, the cap includes a plurality of internal ribs. The internal ribs also preferably comprise an indent portion adjacent the closed end of the rail to secure the cap on the ladder rail.

In the preferred embodiment, the protective ladder cap has two wide internal faces and two narrow internal faces. The internal ribs are on at least one of the wide internal faces, and preferably both. In an even more preferred embodiment, the internal ribs are on the narrow faces as well.

Because the internal ribs taper from a lower height to a higher height, the ladder cap is adapted to receive ladder rails of varying cross-section. Further, the tapered ribs ensure that the ladder cap is secured to the ladder, thus minimizing the ability of the ladder cap to fall off of the ladder rail. Because the ladder cap of the present invention is able to securely fit on ladder rails having varying cross-sections, consumers purchasing ladder caps are not required to know the cross-section size of their ladder rails. Thus, the ladder cap of the present invention also makes it much easier for consumers to purchase a ladder cap that fits snugly on the consumer's ladder.

These and other aspects of the invention are described more fully below.

DETAILED DESCRIPTION OF THE PREFERRED EMBODIMENTS

Figure 1:
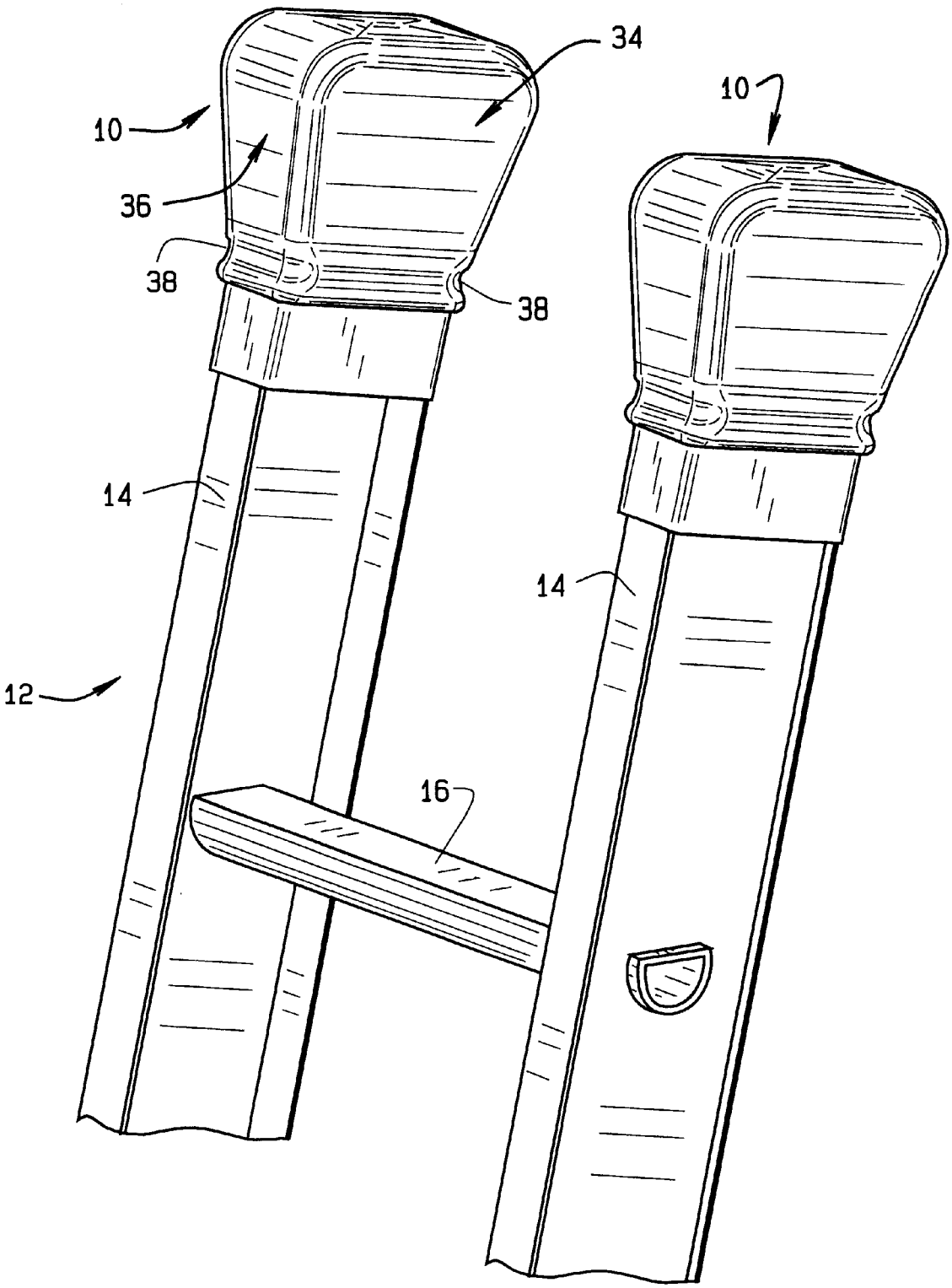
FIG. 1 is a perspective view of the ladder cap of the present invention shown as attached to the ends of the side rails of the ladder.

Referring to FIG. 1, the present invention is directed to a protective ladder cap 10 that is adapted to fit on a ladder 12. The ladder, as is well known, typically includes two side rails 14 and a plurality of rungs 16 (only one shown) that are spaced apart to provide steps for the user. The ladder cap 10 is sized to fit over the ends of the side rails 14 to protect the surface upon which the ladder is resting.

Figure 2:
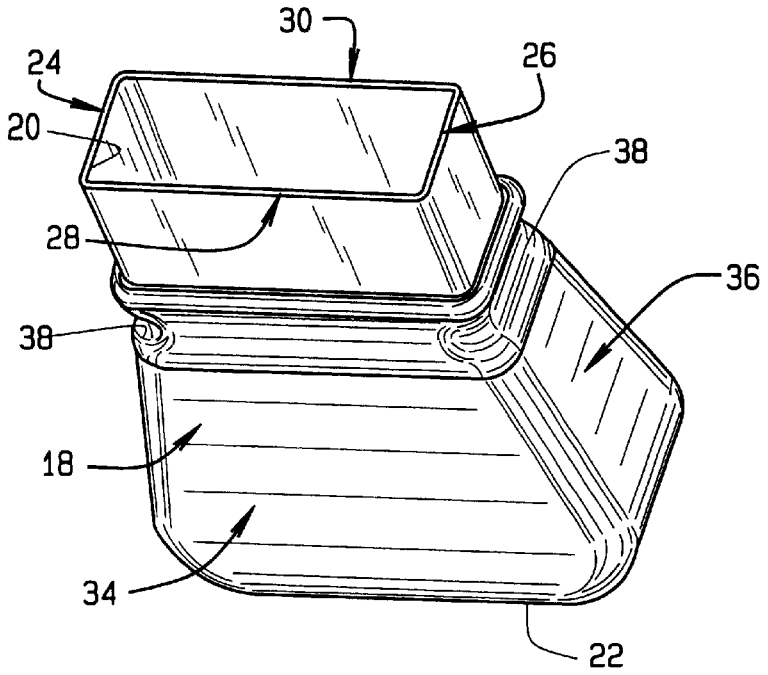
FIG. 2 is a perspective view of the ladder cap of the present invention.
Figure 3:
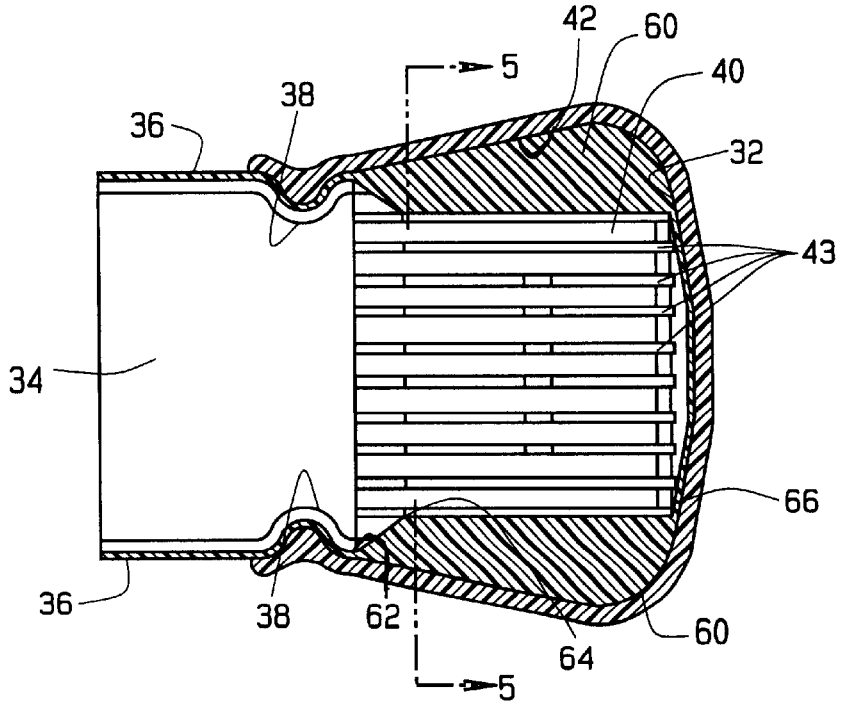
FIG. 3 is a cross-sectional view of the ladder cap, taken along the plane parallel to the side face of the ladder cap and represented by section line 3—3 in FIG. 5.
Figure 4:
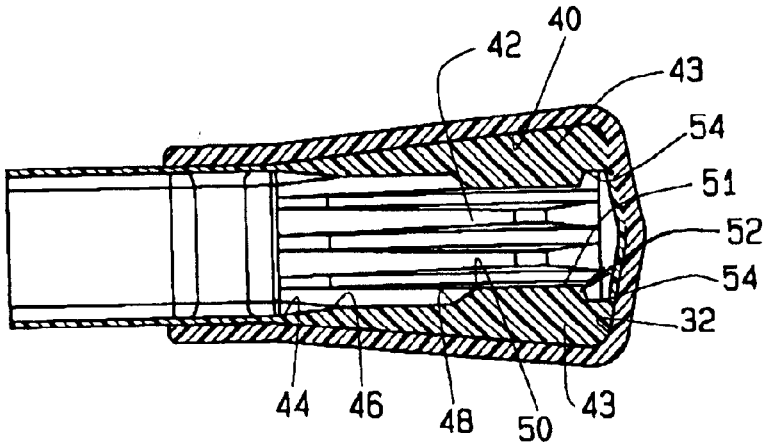
FIG. 4 is a cross-sectional view of the ladder cap, taken along the plane parallel to the side face of the ladder cap and represented by section line 4—4 in FIG. 5.

As shown in FIG. 2, the protective ladder cap 10 comprises a cap 18 that has an open end 20 and a closed end 22. The open end 20 is sized to fit over the end of the side rails. The opening is defined by the length from point 24 to point 26, which is preferably about 3.5 inches and the length from point 28 to point 30, which is preferably about 1.25 inches. The dimensions are sized to allow the ladder cap 10 to be easily slid over the ends of the side rails 14. Referring to FIGS. 3 and 4, the inner surface 32 of the closed end 22 typically abuts against the ends of the side rails when the ladder cap is pushed onto the ladder side rails 14. The cap 18 includes two wide sidewalls 34 and two narrow sidewalls 36, which together with the top or closed end 22 form the cap 18.

As shown best in FIG. 3, the ladder cap 10 includes two opposed side detents 38 that protrude inwardly to engage the side rails. From the detents 38, the two wide sidewalls extend outwardly to the closed end 22 at approximately six degrees and the two narrow sidewalls extend outwardly to the closed end 22 at approximately fourteen degrees (i.e., both walls are angled outwardly slightly). The total height of the ladder cap 10 from the open end 20 to the closed end 22 is approximately 5.5 inches. The total height from the open end 20 to the middle of the detents 38 is approximately 2 inches.

Figure 5:
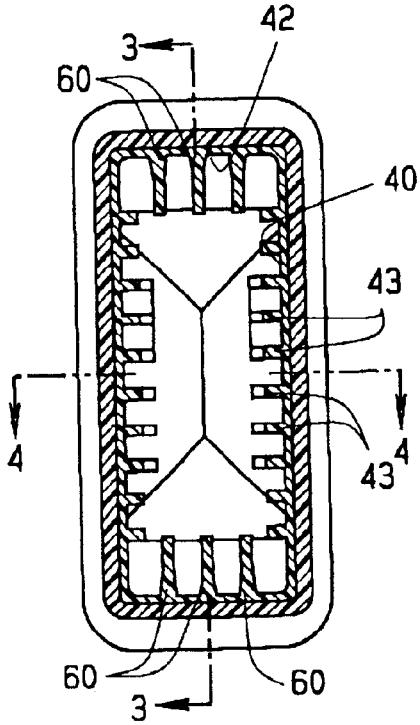
FIG. 5 is a cross-sectional view of the ladder cap, looking directly into the ladder cap and taken along the plane represented by section line 5—5 in FIG. 3.

The two wide sidewalls 34 of the ladder cap 10 have internal wide faces 40 and the two narrow sidewalls have internal narrow faces 42. In the preferred embodiment, the ladder cap 10 includes a plurality of elongated internal wide face ribs 43 on the internal wide faces 40, as shown in FIGS. 3 and 5. Referring to FIG. 4, the length of each wide face rib 43 is approximately 3 inches, and the height tapers from point 44 to a height of approximately 0.094 inches at point 46. The taper from point 44 to point 48 is less than the taper from point 48 to point 50. At point 48, the height of the rib is approximately 0.219 inches and at point 50 the height of the rib is approximately 0.344 inches. The height at point 51 is approximately 0.438 inches. The internal wide ribs 43 preferably include a height of at least 0.250 inches and the rib is preferably tapered from a lower height of around zero inches to the maximum height, as shown in FIG. 4 at point 51. Nonetheless, it is appreciated that the lower height could be more than zero. The lower the height, however, the easier to facilitate a smooth engagement by the end of the ladder rail onto the surface of the internal rib. It should also be understood that the terms "narrow" and "wide" as used herein are used simply as descriptive terms to distinguish between the various sides; the terms should not be construed to be limited to a particular dimension or size.

The wide face ribs 43 also include an indent portion 52 in the preferred embodiment. The indent portion together with the closed end 22 forms a u-shaped channel. The depth from point 51 to the bottom 54 of the indent portion 52 is approximately 0.344 inches. The width of each wide face rib 43 is approximately 0.100 inches and the distance between each rib is approximately 0.210 inches. As shown in FIG. 5, wide face ribs 43 extend inwardly beyond the open end 20 such that when the ladder cap 10 is slid on the end of a side rail 14 through open end 20, the side rail 14 engages the tapered internal wide face ribs 43. If the ladder cap 10 is pushed onto the side rail 14 sufficiently, the side rail lodges into the indent portion 52, further holding the ladder cap 10 on the side rail.

In the preferred embodiment, the ladder cap 10 also has narrow face ribs 60 on the internal narrow faces 42, as shown in FIGS. 3 and 5. The narrow face ribs 60 are approximately the same length as the wide face ribs 43. The rib height tapers from point 62 to a height of approximately 0.438 inches at point 64 to a height of approximately 0.750 inches at point 66. The width of each narrow face rib 43 is approximately 0.100 inches and the distance between each rib is approximately 0.210 inches.

It should be understood that the dimensions are only illustrative. One skilled in the art can readily appreciate how to alter the dimensions provided without departing from the spirit and scope of the invention. The same is true with respect to the number of internal ribs. In fact, the present invention would work, although not preferably, with only one thicker internal rib that engages the side rail when it is inserted into the ladder cap 10. Also, the product will perform well with ribs on only the internal wide faces 40 and will work adequately if the ribs are located only on the side faces 42. By placing ribs on opposed faces, the ladder cap 10 slides over the side rail 14 more evenly and increases the surface area of frictional engagement. In the preferred embodiment, the ladder cap 10 includes at least 5 internal wide face ribs on each wide face 40 and at least two narrow face ribs.

In use, the ladder cap 10 is slid over the end of a side rail 14 through open end 20. The side rail 14 engages the internal ribs 43 and 60. To the extent the ladder cap 10 is slid over a side rail 14 all the way, the side rail 14 should become lodged in not only the detents 38 but also the unshaped channel formed by the indent portions 52 and the closed end 22, thus further securing the ladder cap 10 to the side rail 14. The wide sides 34 and the narrow sides 36 that extend upwardly beyond the detents 38 to form the closed end 22 are approximately 0.250 inches thick.

The ladder cap is preferably made out of a PVC plastic that is a dielectric material. In the preferred embodiment, the material is plastisol.

While a preferred protective ladder cap has been described in detail, various modifications, alterations, and changes may be made without departing from the spirit and scope of the ladder cap according to the present invention as defined in the appended claims.

What is claimed is:

1. A ladder cap comprising:

a cap for fitting over the end of a rail of a ladder, the cap having an open end for fitting over the rail and a closed end, the cap including opposed side walls and opposed end walls, each of the walls being tapered and wider at about the closed end and narrower at about the open end; and at least one elongated internal rib that tapers from a lower rib height closer to the open end than the closed end to a higher rib height closer to the closed end than the open end.

2. The ladder cap of claim 1 wherein the internal rib further comprises an indent portion adjacent the closed end of the cap.

3. The ladder cap of claim 2 wherein the indent portion of the internal rib and the closed end define a channel for receiving at least a portion of the rail when the cap is fitted over the end of the rail.

4. The ladder cap of claim 1 wherein the cap includes a plurality of the internal ribs.

5. The ladder cap of claim 4 wherein the internal ribs include an indent portion adjacent the closed end of the cap.

6. The ladder cap of claim 5 wherein the ladder cap is made of a dielectric material.

7. The ladder cap of claim 6 wherein the material is polyvinyl chloride plastisol.

8. The ladder cap of claim 4 wherein the ladder cap has two wide internal faces and two narrow internal faces and the internal ribs are on at least one of the wide internal faces.

9. The ladder cap of claim 8 wherein the internal ribs are on the two wide internal faces.

10. The ladder cap of claim 9 wherein the internal ribs are on the two wide faces Ad and the two narrow faces.

11. The ladder cap of claim 1 wherein there are at least five internal ribs on each wide face.

12. The ladder cap of claim 11 wherein the higher rib height of the internal ribs is at least ¼ of an inch in height.

13. The ladder cap of claim 1 wherein there are at least five internal ribs on each wide face and there are at least two internal ribs on each narrow face.

14. The ladder cap of claim 13 wherein the higher rib height of the internal ribs on each wide face are at least ¼ of an inch and the higher rib height of the internal ribs on each narrow face are at least ⅜ of an inch in height.

15. The ladder cap of claim 1 wherein the ladder cap material is plastic.

16. The ladder cap of claim 1, further comprising detents disposed at about the open end of the cap, the detents being configured to constrict around the ladder rail received therein.

17. The ladder cap of claim 1 wherein the lower rib height is about zero inches.

18. A ladder cap for covering an end of a ladder side rail, the ladder cap comprising:

a cap having at least two narrow sides, two wide sides, and a top, the narrow sides, wide sides and top defining an open end for fitting over the rail and a closed end, each of the narrow and wide sides being tapered and wider at about the closed end and narrower at about the open end; and a plurality of internal ribs on the two wide sides for engaging the ladder side rail, wherein each of the plurality of internal ribs on the two wide sides comprises an indent portion.

19. The ladder cap of claim 18, further comprising detents disposed at about the open end of the cap, the detents being configured to constrict around the ladder rail received therein.

20. The ladder cap of claim 18 wherein the indent portions of the plurality of internal ribs on the two wide sides are adjacent the closed end of the cap.

21. The ladder cap of claim 20 wherein the indent portions of the plurality of internal ribs on the two wide sides and the closed end define a channel for receiving at least a portion of the rail when the cap is fitted over the end of the rail.

22. The ladder cap of claim 18 wherein internal ribs are on the two wide sides and the two narrow sides and wherein the rib height of the internal ribs on the two wide sides is at least ¼ of an inch and the rib height of the internal ribs on the two narrow sides is at least ⅜ of an inch in height.

23. The ladder cap of claim 18 wherein the plurality of internal ribs on the two wide sides are tapered.

24. The ladder cap of claim 18 wherein the rib height of the internal ribs is at least ¼ of an inch.

25. A ladder cap for covering an end of a ladder side rail, the ladder cap comprising:

a cap having at least two narrow sides, two wide sides, and a top, the narrow sides, wide sides and top defining an open end for fitting over the rail and a closed end, each of the narrow and wide sides being tapered and wider at about the closed end and narrower at about the open end; and a plurality of internal tapered ribs on the two wide sides for engaging the ladder side rail.

26. The ladder cap of claim 25, further comprising detents disposed at about the open end of the cap, the detents being configured to constrict around the ladder rail received therein.

27. The ladder cap of claim 25 wherein the tapered ribs also include an indent portion adjacent the closed end of the cap.

28. The ladder cap of claim 27 wherein the indent portions of the ribs and the closed end define a channel for receiving at least a portion of the rail when the cap is fitted over the end of the rail.

29. The ladder cap of claim 27 wherein the internal tapered ribs are on the two narrow sides.

30. A ladder cap for covering an end of a ladder side rail, the ladder cap comprising:

a cover adapted to fit over the end of the ladder side rail, and defining an open end for receiving the end of the ladder side rail and a closed end, the cap including two narrow sides and two wide sides, each of the narrow and wide sides being tapered and wider at about the closed end and narrower at about the open end; and tapered means, within the cover, for frictionally engaging the end of the ladder side rail when the end of the ladder side rail is received through the open end.

31. A ladder cap for covering an end of a ladder side rail, the ladder cap comprising:

a cover adapted to fit over the end of the ladder side rail, and defining an open end for receiving the end of the ladder side rail and a closed end, the cap including two narrow sides and two wide sides, each of the narrow and wide sides being tapered and wider at about the closed end and narrower at about the open end; and means, within the cover, for frictionally engaging the end of the ladder side rail when the end of the ladder side rail is received through the open end, and comprising retention means for retaining the cover on the end of the ladder side rail when a sufficient portion of the ladder side rail has been received through the open end.

* * * * *

UNITED STATES PATENT AND TRADEMARK OFFICE

CERTIFICATE OF CORRECTION

PATENT NO. : 6,499,563 B1
DATED : December 31, 2002
INVENTOR(S) : Lori J. Bremick It is certified that error appears in the above-identified patent and that said Letters Patent is hereby corrected as shown below:

Column 3,
Line 59, replace "unshaped" with -- u-shaped --

Column 4,
Line 38, delete "Ad"

Signed and Sealed this

Twenty-second Day of April, 2003

JAMES E. ROGAN
*Director of the United States Patent and Trademark Office*